US010504525B2

(12) United States Patent
Sun et al.

(10) Patent No.: US 10,504,525 B2
(45) Date of Patent: Dec. 10, 2019

(54) ADAPTIVE FORWARD ERROR CORRECTION REDUNDANT PAYLOAD GENERATION

(71) Applicant: Dolby Laboratories Licensing Corporation, San Francisco, CA (US)

(72) Inventors: Xuejing Sun, Beijing (CN); Kai Li, Beijing (CN); Mark S. Vinton, Alameda, CA (US); Shen Huang, Beijing (CN)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/287,953

(22) Filed: Oct. 7, 2016

(65) Prior Publication Data

US 2017/0103761 A1 Apr. 13, 2017

Related U.S. Application Data

(60) Provisional application No. 62/293,422, filed on Feb. 10, 2016.

(51) Int. Cl.

| | |
|---|---|
| ***G10L 19/005*** | (2013.01) |
| ***G10L 19/028*** | (2013.01) |
| ***G10L 19/02*** | (2013.01) |

(52) U.S. Cl.

CPC ..... *G10L 19/005* (2013.01); *G10L 19/0204* (2013.01); *G10L 19/028* (2013.01)

(58) Field of Classification Search

CPC ..... G10L 19/026; G10L 19/005; G10L 19/06; G10L 19/0268; G10L 19/0204; H04L 1/0078

USPC ..... 704/205; 714/751

See application file for complete search history.

(56) References Cited

U.S. PATENT DOCUMENTS

| | | | | |
|---|---|---|---|---|
| 6,389,391 | B1 | 5/2002 | Terauchi | |
| 6,757,654 | B1 * | 6/2004 | Westerlund | G10L 19/005 704/219 |
| 7,668,712 | B2 | 2/2010 | Wang | |
| 8,489,954 | B2 | 7/2013 | Seferoglu | |
| 8,527,265 | B2 * | 9/2013 | Reznik | G10L 19/24 704/200 |
| 8,588,093 | B2 | 11/2013 | Yoneda | |

(Continued)

FOREIGN PATENT DOCUMENTS

| | | |
|---|---|---|
| CN | 102035825 | 4/2011 |
| WO | 2014/202770 | 12/2014 |

OTHER PUBLICATIONS

Geiser, Bernd, et al. "Joint pre-echo control and frame erasure concealment for VoIP audio codecs." Signal Processing Conference, 2009 17th European. IEEE, Aug. 2009, pp. 1259-1263.*

(Continued)

*Primary Examiner* — James S Wozniak

(57) ABSTRACT

A method of encoding audio information for forward error correction reconstruction of a transmitted audio stream over a lossy packet switched network, the method including the steps of: (a) dividing the audio stream into audio frames; (b) determining a series of corresponding audio frequency bands for the audio frames; (c) determining a series of power envelopes for the frequency bands; (d) encoding the envelopes as a low bit rate version of the audio frame in a redundant transmission frame.

14 Claims, 7 Drawing Sheets

(56) References Cited

U.S. PATENT DOCUMENTS

| | | | | |
|---|---|---|---|---|
| 8,831,959 | B2 * | 9/2014 | Grancharov | G10L 19/02 341/55 |
| 9,330,672 | B2 * | 5/2016 | Guan | G10L 19/02 |
| 2002/0138268 | A1 * | 9/2002 | Gustafsson | G10L 21/038 704/258 |
| 2004/0015765 | A1 | 1/2004 | Cooper | |
| 2009/0111507 | A1 * | 4/2009 | Chen | H04M 1/6008 455/550.1 |
| 2009/0326942 | A1 * | 12/2009 | Fulop | G10L 17/02 704/246 |
| 2010/0286805 | A1 * | 11/2010 | Gao | G10L 19/0017 700/94 |
| 2010/0312552 | A1 * | 12/2010 | Zheng | H04L 1/0009 704/219 |
| 2011/0066429 | A1 * | 3/2011 | Shperling | G10L 25/78 704/228 |
| 2011/0261145 | A1 | 10/2011 | Kamath | |
| 2012/0109659 | A1 * | 5/2012 | Wu | G10L 19/0212 704/500 |
| 2012/0146831 | A1 * | 6/2012 | Eksler | G10L 19/038 341/200 |
| 2012/0265523 | A1 * | 10/2012 | Greer | G10L 19/24 704/201 |
| 2013/0185084 | A1 * | 7/2013 | Rajendran | G10L 19/04 704/500 |
| 2015/0106106 | A1 * | 4/2015 | Atti | H04L 1/0014 704/500 |
| 2015/0255077 | A1 | 9/2015 | Schuller | |
| 2016/0379652 | A1 * | 12/2016 | Lecomte | G10L 19/02 704/500 |
| 2017/0103760 | A1 * | 4/2017 | Naslund | G10L 19/025 |
| 2017/0103761 | A1 * | 4/2017 | Sun | G10L 19/005 |

OTHER PUBLICATIONS

Huang, Shen, et al. "Time Domain Extrapolative Packet Loss Concealment for MDCT Based Voice Codec." Audio Engineering Society Convention 138. Audio Engineering Society, May 2015, pp. 1-7.*

Lecomte, Jérémie, et al. "Packet-loss concealment technology advances in EVS." Acoustics, Speech and Signal Processing 2015 IEEE International Conference on. IEEE, Apr. 2015, pp. 5708-5712.*

Lecomte, Jérémie, et al. "Enhanced time domain packet loss concealment in switched speech/audio codec." Acoustics, Speech and Signal Processing (ICASSP), 2015 IEEE International Conference on. IEEE, Apr. 2015, pp. 5922-5926.*

Ofir, Hadas. Packet loss concealment for audio streaming. Technion-Israel Institute of Technology, Faculty of Electrical Engineering, Jun. 2006, pp. 1-183.*

Ragot, Stephane, et al. "ITU-T G. 729.1: An 8-32 kbit/s scalable coder interoperable with G. 729 for wideband telephony and Voice over IP."Acoustics, Speech and Signal Processing, 2007. ICASSP 2007. IEEE International Conference on. vol. 4. IEEE, Apr. 2007, pp. 529-532.*

Ryu, Sang-Uk, et al. "Encoder assisted frame loss concealment for MPEG-AAC decoder." Acoustics, Speech and Signal Processing, 2006. ICASSP 2006 Proceedings. 2006 IEEE International Conference on. vol. 5. IEEE, May 2006, pp. 1-4.*

Zhu, Meng-Yao, et al. "Streaming audio packet loss concealment based on sinusoidal frequency estimation in MDCT domain." IEEE Transactions on Consumer Electronics 56.2, Jul. 2010, pp. 811-819.*

Bolot, Jean-Chrysostome et al "Adaptive FEC-based Error Control for Internet Telephony" IEEE Eighteenth Annual Joint Conference of the IEEE Computer and Communications Societies, Mar. 21-25, 1999, pp. 1453-1460.

Jiang, W. et al "Comparison and Optimization of Packet Loss Repair Methods on VoIP Perceived Quality Under Bursty Loss" Workshop on Network and Operating System Support for Digital Audio and Video, May 12-14, 2002, pp. 73-81.

Sanneck, H. et al "Speech Property-Based FEC for Internet Telephony Applications" Proc. of the SPIE Multimedia Computing and Networking Conference, Jan. 2000, pp. 1-14.

Rahnama, B. et al "A Novel no-Latency Simple-to-Implement Sender-based Packet-Loss Recovery Technique for Multimedia Streams" IEEE International Symposium on Computer Networks, Jun. 16-18, 2006, pp. 192-196.

Wah, Lee Kah et al "Adaptive Bandwidth-Constrained Media-Specific Forward Error Correction for Voice over Internet Protocol" IEEE International Conference on Networks, Aug. 27-30, 2002, pp. 455-460.

Nafaa, A. et al "Forward Error Correction Strategies for Media Streaming over Wireless Networks" IEEE Communications Magazine, vol. 46, Issue 1, pp. 72-79, Jan. 7, 2008.

* cited by examiner

ADAPTIVE FORWARD ERROR CORRECTION REDUNDANT PAYLOAD GENERATION

CROSS REFERENCE TO RELATED APPLICATIONS

This application claims the benefit of U.S. Provisional Application No. 62/293,422, filed Feb. 10, 2016, and International Application Number PCT/CN2015/091609 filed Oct. 10, 2015, which is incorporated herein by reference.

FIELD OF THE INVENTION

The present invention relates to an adaptive low-bitrate (LBR) redundant (RED) payload creation for forward error correction (FEC) purposes. The present invention has application to transform based codecs, in particular, modified discrete cosine transform (MDCT) based codecs, but is not necessarily limited to MDCT based codecs.

BACKGROUND

Any discussion of the background art throughout the specification should in no way be considered as an admission that such art is widely known or forms part of common general knowledge in the field.

FEC is a frequently employed sender-based redundant encoding technique to combat packet loss in a packet-switch networks. Media-independent FEC, such as Reed-Solomon (RS) codes, produces n packets of data from k packets such that the original k packets can be exactly recovered by receiving any subset of k (or more) packets. On the other hand media-dependent FEC generates a redundant packet or payload that is often of lower bitrate (LBR) and consequently the recovered signal has lower quality than the original audio signal. LBR payload can be created using the same codec for the primary encoding when the codec supports the required low bitrate, or a completely different low bitrate codec (often with higher complexity).

It is evident that FEC improves voice quality by increasing bandwidth consumption and delay with redundant payloads, which can sometimes lead to unnecessary waste of significant network bandwidth, and even worse, degraded performance due to network congestion.

To address this issue, practical systems are often designed to be adaptive. For example, Bolot et al. adjusts FEC redundancy and coding rate dynamically according to the measured packet loss rate, which is estimated somewhere in the network and signalled back to the sender, e.g., through RTCP.

REFERENCES

[1] W. Jiang, H. Schulzrinne: Comparison and optimization of packet loss repair methods on VoIP perceived quality under bursty loss, Proc. Int. Workshop on Network and Operating System Support for Digital Audio and Video (2002)

[2] J.-C. Bolot, S. F. Parisis, and D. Towsley, "Adaptive FEC-based error control for Internet Telephony," in Infocom '99, March 1999.

SUMMARY OF THE INVENTION

It is an object of the invention, in its preferred form to provide an improved form adaptive FEC system and method.

In accordance with a first aspect of the present invention, there is provided a method of encoding audio information for forward error correction reconstruction of a transmitted audio stream over a lossy packet switched network, the method including the steps of: (a) dividing the audio stream into audio frames (e.g., into a first series of audio frames); (b) determining a series of corresponding audio frequency bands for the audio frames (e.g., for each of the audio frames); (c) determining a series of power envelopes for the frequency bands (e.g., for each audio frame, one power envelope per frequency band); (d) encoding the envelopes as a low bit rate version of the audio frame in a redundant transmission frame (e.g., for each audio frame, encoding the envelopes as a low bit rate version of the audio frame in a redundant transmission frame). Here, low bit rate may indicate that the bit rate of the redundant transmission frame is lower (e.g., substantially lower) than the bit rate of the corresponding audio frame. The power envelopes may represent the power (e.g., log-scaled power) in each frequency band, e.g. with 3 dB precision.

The step (c) and step (d) further can comprise (c1) determining phase and magnitude data (e.g., low resolution phase and magnitude data) from the audio frequency bands for the audio frames; and (d1) encoding the phase and magnitude data (e.g., low resolution phase and magnitude data) as part of the redundant transmission frame. Here, low resolution may refer to a lower resolution (e.g., substantially lower resolution) than the original magnitude and phase data (e.g., quantized MDCT spectrum data and sign information). In some embodiments, the step: (e) can include, when decoding the redundant transmission, adding noise to the output signal by utilising a noise generator. The noise generator can generate noise parameterised by the data in the redundant transmission frame. That is, noise generation by the noise generator may depend on the data in the redundant transmission frame.

In some embodiments, only the lower frequency phase and magnitude data (e.g., the phase and magnitude data of a number of the lowest frequency bands) are encoded as part of the redundant transmission frame. The lower frequency phase and magnitude data may be phase and magnitude data for frequency bands (starting from a lowest frequency band) up to a given number of frequency bands (e.g., the lowest frequency band or a number of lowest frequency bands). The given number may relate to a cutoff, e.g., cutoff frequency. The cutoff for the number of lower frequency phase and magnitude data (e.g., for the number of the lowest frequency bands) can be determined from (e.g., on the basis of) the audio content of the corresponding audio frame. For example, determining the cutoff may involve analysing the content of the corresponding audio frame. If the content of the audio frame is of a vowel type, the cutoff may be set to a lower value. Otherwise, if the content of audio frame is a fricative, the cutoff may be set to a higher value. In general, the cutoff may be determined based on whether the content of the audio frame is of a vowel type or a fricative.

The method may further include: (e) when decoding the redundant transmission (e.g., at the time of reconstructing the audio stream at a decoder), adding noise to the output signal by utilising a noise generator at the time of reconstructing the audio stream. Said noise generator may generate noise parameterised by the data in the redundant transmission frame. For example, the noise generator may be configured to parameterize the generated noise by the data in the redundant transmission frame. That is, the noise may be generated based on the data in the redundant transmission frame.

In accordance with another aspect of the present invention, there is provided a fault tolerant audio encoder for encoding an audio signal into a fault tolerant version of the audio signal, the encoder including: a primary encoder for encoding the audio signal in a first encoding format, comprising a first series of audio frames, with each audio frame including encoded information for a series of frequency bands; a redundant encoder for encoding the audio signal in a redundant encoding format comprising a second series of audio frames, with each audio frame including encoded information of the power envelopes for frequency bands of the audio frame; and forward error correction encoder for combining said first encoding format and said redundant encoding format to produce said fault tolerant version of the audio signal. In some embodiments, the encoded information of the power envelopes is Huffman encoded across adjacent frames in said second series of audio frames.

In accordance with a further aspect of the present invention, there is provided a method of decoding a received fault tolerant audio signal, received as packets in a lossy packet switching network environment, the fault tolerant audio signal including: a first series of audio frames, with each audio frame including spectral encoded information for a series of frequency bands; a second series of audio frames, with each audio frame including power envelope information for frequency bands of the audio frame, the method including, upon detection of a lost packet, the step of: replicating the spectral data from a previous frame modulated by the power envelop information for a current frame; or generating a current frame from the power envelop information for a current frame and a spectral noise generator (e.g., spectral noise random generator).

In some embodiments, the output of the spectral noise generator (e.g., spectral noise random generator) is based on (e.g., correlated with) the spectral data of a previous audio frame.

BRIEF DESCRIPTION OF THE DRAWINGS

Embodiments of the invention will now be described, by way of example only, with reference to the accompanying drawings in which.

DETAILED DESCRIPTION

The preferred embodiment provides for the control over the FEC bandwidth based on audio content and how to reduce FEC delay to the minimum. In the present embodiments, various LBR schemes are presented, which allows bandwidth and delay to be minimized.

Figure 1:
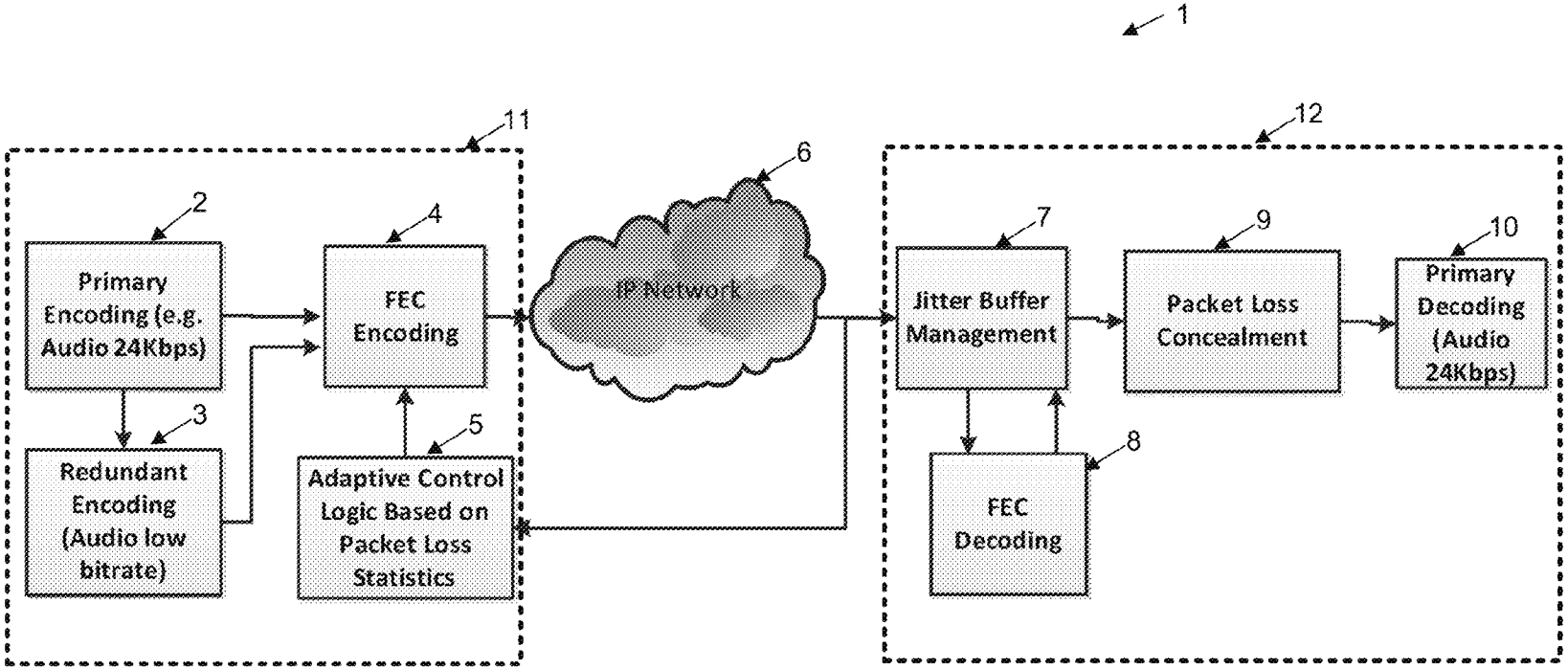
FIG. 1 illustrates schematically the process of encoding forward error corrected information for encoding, transmission and decoding of audio signals.

FIG. 1 illustrates an example system or environment of operation of the preferred embodiment. In this arrangement 1, audio is transmitted from an encoding unit 11 via an IP network 6 to a decoding unit 12. A first high fidelity primary encoding of the signal 2 is provided at the source end. This can be derived from speaker input or generated from other audio sources. From the primary encoding, a redundant low bit rate encodings 3 is also provided. Here, low bit rate may refer to any bit rat lower (e.g., substantially lower) than the bit rate of the primary encoding. The two encodings are utilised by a FEC encoder 4 under the control of adaptive control unit 5 to produce a FEC output encoding (e.g., a fault tolerant audio signal) for dispatch over IP packet switching network 6.

The packets are received by decoding unit 12, and inserted into a jitter buffer 7. Subsequently, the FEC is decoded, before lost packet concealment 9 is carried out, followed by primary decoding 10. That is, the fault tolerant audio signal is decoded by a FEC decoder 8, to produce the primary encoding (e.g., a first series of frames) and the redundant low bit rate encoding (e.g., a second series of audio frames).

The preferred embodiment provides for a hybrid envelope-based LBR of the audio signal (partial LBR payload) and an adaptive envelope-based LBR (partial LBR payload) and normal LBR based on the encoded audio content, and an adaptive delayless LBR and normal LBR based on delay requirements.

The preferred embodiment assumes an encoding of a MDCT encoded bitstream, having a desired low bit rate transmission. It is assumed the MDCT codec supports multiple different bit rates, for example, from 6.4 kbps to 24 kbps. The invention has application to many different forms of MDCT-based low bit rate payloads. In particular, the embodiments have application to a layered encoding scheme where various levels of encoding can be easily stripped off.

Envelope Based Payload

Figure 2:
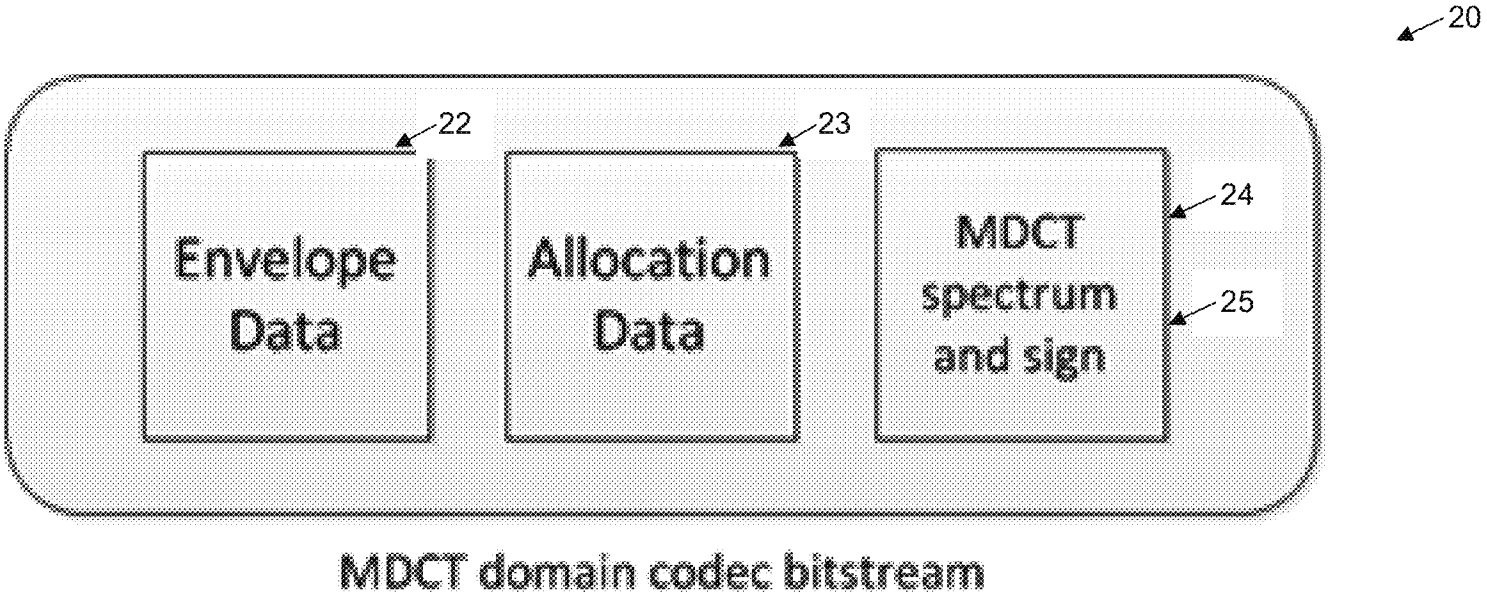
FIG. 2 illustrates an example data format for encoding an MDCT bitstream.
Figure 3:
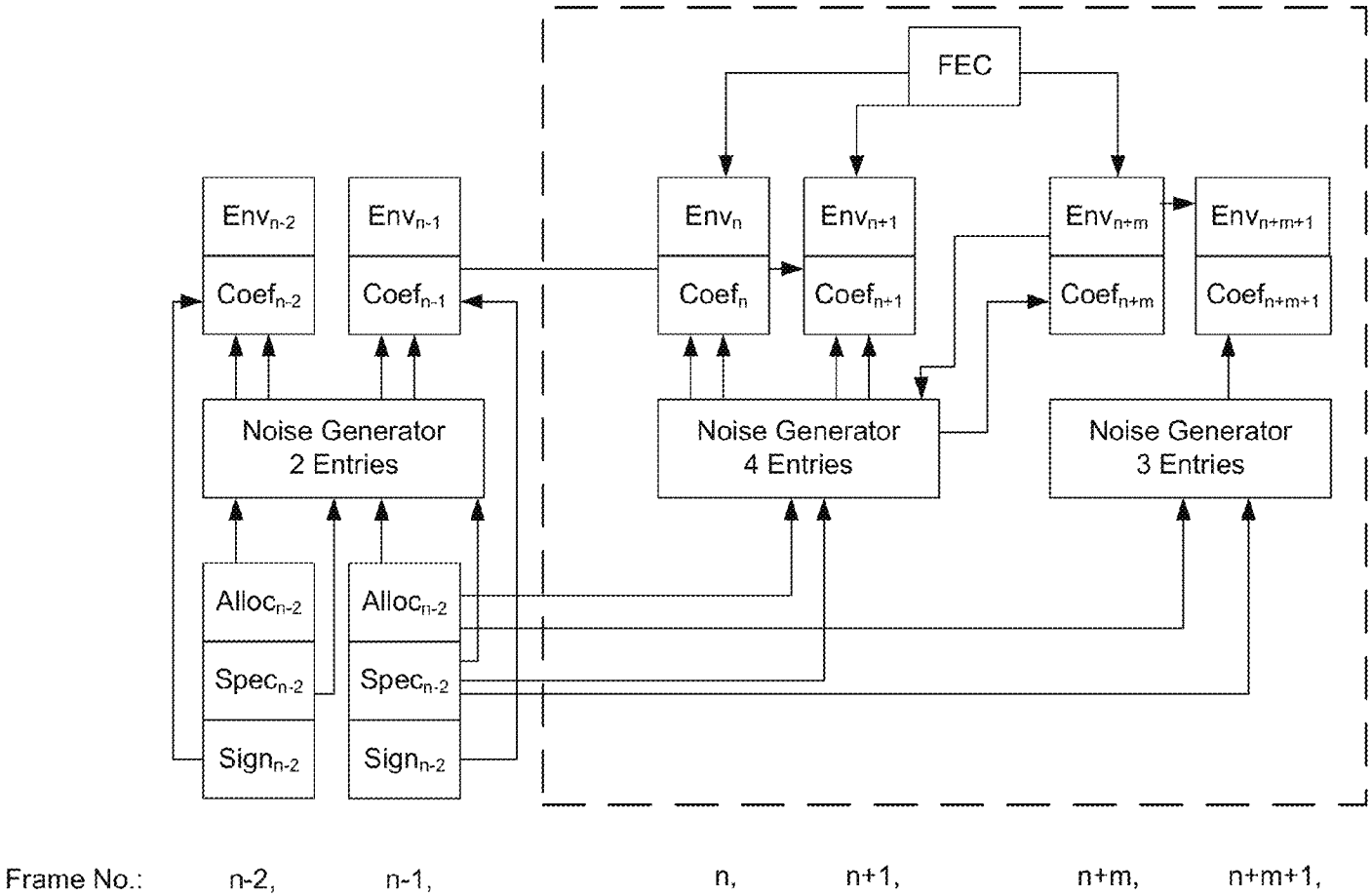
FIG. 3 illustrates schematically the concept of a position dependant envelope redundant payload creation based on Forward Error Correction.
Figure 4:
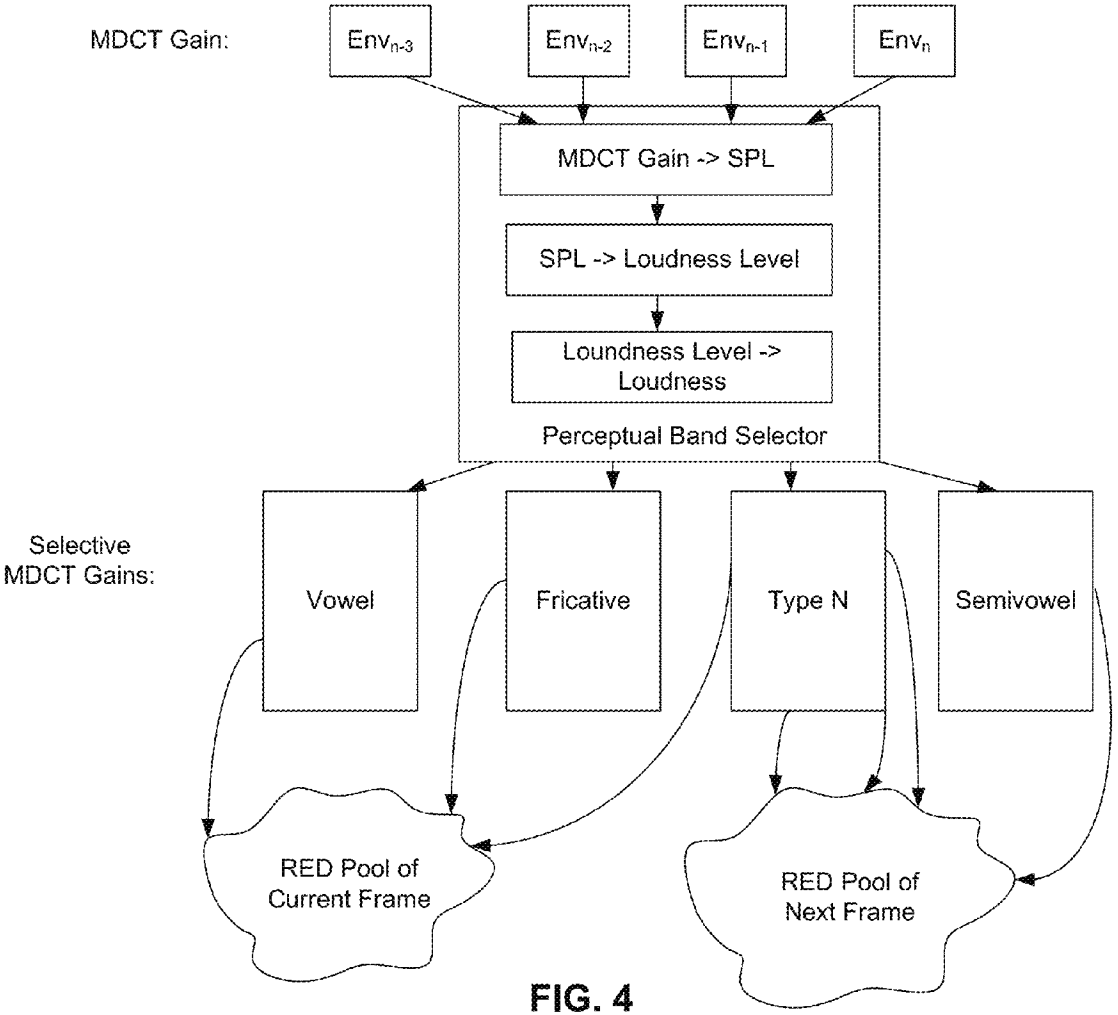
FIG. 4 illustrates schematically a band selective envelope redundancy based FEC.

The MDCT encoding may not be inherently scalable, i.e. it doesn't have a layered design that allows for the elimination of a portion of payload to generate a different bitrate LBR REDs simply in real time. However, as is usual, a MDCT encoding may have a bit-stream structure that can be separated as three components as illustrated in FIG. 2, including 1) Envelope 22; 2) Allocation data 23; and 3) Spectrum data 24, 25.

Since the envelope 22 is independent of spectrum, it is the most feasible information that can be readily extracted.

A low bit rate payload can be generated based on the envelope. The envelope data can be Huffman coded using delta information across adjacent bands, which is very content dependent. On average for a 24 kbps codec, the bitrate for envelope data may only be of 10% of the total bitrate.

In addition to lower bitrate, creating an envelope only LBR is computationally very efficient since no additional encoding for metadata generation is needed. Whilst having a low bit rate, the envelope also carries critical information needed for reconstruction of the audio signal, which makes it suitable for generating a low bitrate payload.

Position Dependent Envelope RED:

Encoding only envelope information may not be enough for representing speech. It therefore can be integrated with auxiliary information such as speech spectrum. For envelope based FEC, both MDCT spectrum coefficients and the signs of previous frames can be utilized to provide enhanced information for better speech quality.

However, speech articulation is a process that changes rapidly, excessive extrapolation of information from previous frame could incur annoying robotic artifacts, or pathological sounding voices. If no solution is taken towards that issue, a FEC using the envelope only could be even more catastrophic. The position-dependent envelope based RED are:

RED with Spectral Repetition:

For the first few repair frames, frame information can consists of sign, spectrum data from previous frame and envelope based RED from FEC:

$$\mathrm{Bit}(n,k)=\mathrm{RED}(n,k)\cup\mathrm{Coef}(n-1,k);$$

where n is the frame index and k is the band index. When reconstructing MDCT coefficients, spectrum and allocation information can be jointly utilized to decide a MDCT noise generator.

RED with Noise Generator:

For the rest of the repaired frames, frame information consists of envelope based RED from the FEC and an MDCT random noise generator (represented by GEN function in the following equation), which depends not only on band index, spectrum and allocation information from a corresponding band of previous frame, but also the RED of current frame, in order to achieve optimal perceptual continuity:

$$\mathrm{Bit}(n,k)=\mathrm{RED}(n,k)\cup\mathrm{GEN}(k,\mathrm{Spec}(n-1,k),\mathrm{Alloc}(n-1,k),\mathrm{RED}(n,k));$$

If the RED in the FEC has been used, the previous RED can be used as the RED for the current frame, and the same noise generator can be used, in this case, the frame component consists of:

$$\mathrm{Bit}(n,k)=\mathrm{RED}(n-1,k)\cup\mathrm{GEN}(k,\mathrm{Spec}(n-1,k),\mathrm{Alloc}(n-1,k));$$

In this solution, instead of transmitting the actual spectral components of a noisy signal, the bit-stream can just mark that this frequency band is a noise-like one and a band dependent noise generator can replace the function of the MDCT coefficients. Using a quantized spectral envelope in each scale factor band along with a noise generator, one can generate comfort noise which is similar to a whisper voice.

Band Selective Enveloped RED

Experimental examination of bitstream data has revealed, to some extent, that only using bit-stream information of the first few spectral bands is sufficient for coding whisper or some of the frames in a vowel sound. For the rest of the bands, it is possible to keep them at an average level around long term information. This implies that we can utilise a selective scheme that can achieve a much lower bitrate RED with comparable performance.

An intelligent band selection scheme is therefore proposed by considering the frame's content type. If the content of the frame is of a vowel type, we may need to use a low frequency band and reduce the weight of the high frequency band. Otherwise, if the content of frame is a fricative, the high frequency bands can be utilised with a higher weight. For example, a cutoff (e.g., frequency cutoff, or a cutoff number) up to which frequency bands are used can be determined on the basis of the frame's content type, e.g., on the basis of whether the content of the frame is of a vowel type or a fricative.

An intelligent detecting module at the encoder can decide which combination of selective bands will be chosen for encoding RED by using perceptual loudness conversion from the MDCT envelope (energy level) to band loudness at each MDCT band.

Envelope Plus Signs

Figure 5:
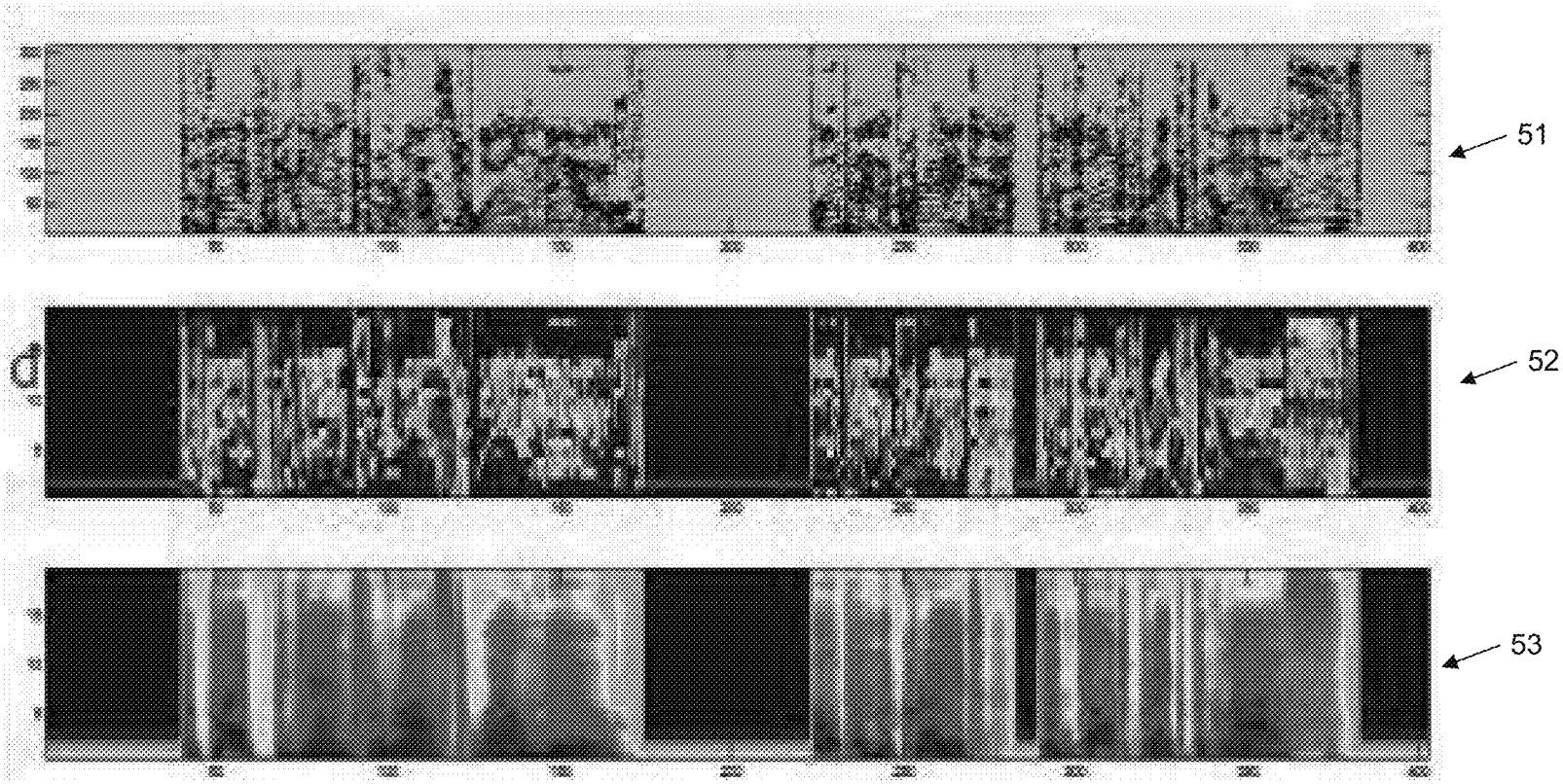
FIG. 5 illustrates the information content of the spectrum after stripping off the MDCT envelope.

As illustrated in FIG. 2, the envelope 22 serves for the purpose of normalizing band spectrum. After this is stripped off from the frame encoding, the rest of the spectrum has three parts: 1) Allocation data 23; 2) Quantized MDCT spectrum data and 3) Sign information 24, 25. Among these three data sources, the sign consumes the least space and implies phase information using a Boolean value. For example, FIG. 5 illustrates pictorially, the information content of the spectrum after removal of the MDCT envelope information with the strip 51 being the sign, the strip 52 being the allocation bits and the strip 53 being the quantized spectrum.

Transmitting both envelope and signs can improve the results as validated by informal listening, although the improvement is incremental at best. That is, signs of frequency coefficients (e.g., MDCT coefficients) for respective frequency bands can be encoded together with the envelopes in a redundant transmission frame. Some preliminary work shows that designing an efficient scheme to transmit the signs is a challenging task with diminishing returns. Transmitting the sign only is not really feasible with some MDCT encoded signal codecs as it needs to know which coefficients are nonzero. Various embodiments can be constructed nevertheless as discussed below:

Peak Picking Selective Sign Transmission:

Unlike envelope band selection which can only be implemented at a band level, a selection of sign transmissions could proceed at the bin level. Bins with peak MDCT energy will be selected as transmitted RED, whereas stabilized MDCT energy can be obtained from pseudo spectrum of the MDCT in accordance with the following measure:

$$\mathrm{PPX}_d=\mathrm{MDCT}_d^2+(\mathrm{MDCT}_{d-1}-\mathrm{MDCT}_{d+1})^2$$

The peak area of $\mathrm{PPX}_d$ will be selected as the transmitted sign. Again, how many signs are selected depends on the network condition and payload size requirement. However, informal POLQA tests show that using the true sign has lower MOS than using the true envelope. Therefore, the envelope still has the first priority, if there is any more room given for RED, the peak sign can be considered as an ancillary transmission.

Delayless LBR

The aforementioned FEC schemes require extra delay in order to decode the FEC RED payload. In real time communication systems, adding extra delay sometimes may degrade the voice communication experience. Therefore, in order to address the delay problem, the following solution provides a method that allows decoding the RED payload without increasing the system latency.

For MDCT based codecs, a single packet loss normally affects two adjacent PCM audio frames. To remedy the impact of packet losses, packet replication can be performed at the receiver, and is commonly used for error concealment in the prior art. In this method, the MDCT frame before the lost packet is re-used by performing an inverse transform (IMDCT) on the coefficients and subsequently an overlap-add operation using the resulting time domain signal. This approach is easy to implement and achieves acceptable results in some cases because of the cross-fading process. However, with this process, the time-domain aliasing cancellation (TDAC) property does not hold anymore. As a result, it is not possible to achieve perfect reconstruction of the original signal. For certain type of signals, such as percussion sounds, this can lead to serious artifacts.

Set out below is an approach to embed more information to the current MDCT packet such that the lost packet can be reconstructed at the receiver. Since a lost packet can affect two adjacent time domain signal blocks, we will first describe how to construct the first half of the signal.

Figure 6:
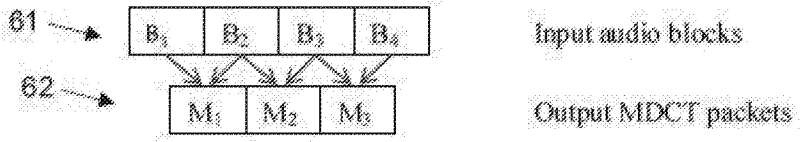
FIG. 6 PRIOR ART
FIG. 6 illustrates the conventional encoding process.

Initially, as illustrated in FIG. 6, let $B_1, B_2, \ldots B_N$ denote a series of data blocks 61. The MDCT coefficients $M_1$, $M_2$ . . . 62 can be generated from $[B_1B_2]$, $[B_2B_3]$ . . . respectively.

Figure 7:
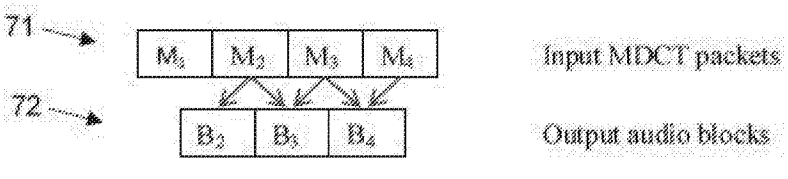
FIG. 7 PRIOR ART
FIG. 7 illustrates the conventional decoding process.

As shown in FIG. 7, at the receiver, it is necessary to decode $M_1$ to get the first half of $B_2$ (aliased version) and $M_2$ to get the second half of $B_2$ (aliased version), then perform overlap-add to fully reconstruct $B_2$.

Figure 8:
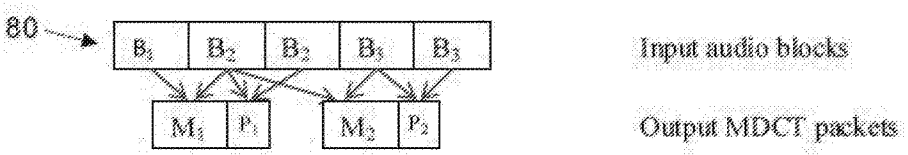
FIG. 8 illustrates a modified form of encoder.

In order to reconstruct the second half $B_2$ at the receiver when $M_2$ is lost, the proposed solution is that after $M_1$ is generated at the encoder, another forward MDCT transform is performed on $[B_2B_2]$ or $[B_2\mathbf{0}]$ to get another set of MDCT coefficients $P_1$, i.e. constructing an input vector by repeating the block or inserting a block of zeros. Such a process is illustrated in FIG. 8.

Figure 9:
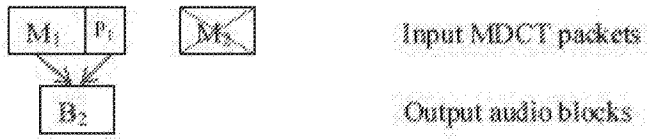
FIG. 9 illustrates the audio reconstruction process when a packet is lost.

In fact, it is possible to fill the second half with any signals and still reconstruct the block $B_2$ at the receiver due to the independence property of the MDCT. Then in the new packet we need to store both $M_1$ and $P_1$. At the receiver, when the packet containing $M_1$ and $P_1$ is received, both the fadeout and fadein signals required for overlap-add can be reconstructed by inverse transforming $M_1$ and $P_1$ respectively (FIG. 9). Depending on the signal type, packet loss rate, playback device, and quality requirements, the reconstructed fadein signal from $P_1$ may not need to contain all the fine structure. This allow us perform more aggressive quantization on $P_1$ thus lowering the bitrate. Furthermore, instead of using $[B_2B_2]$ or $[B_2\ 0]$ to get $P_1$, the signal can be constructed in such a way that the resulted quantization consumes the least number of bits. This may involve an analysis-by-synthesis process.

The above method only provides a way to reconstruct the overlap portion during a packet loss. In order to re-generate the next overlap portion required for reconstructing the next audio frame, this method can be extended as described below.

Figure 10:
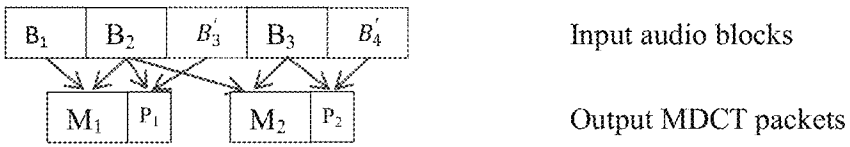
FIG. 10 illustrates one form of encoder with a pre-PLC method.
Figure 11:
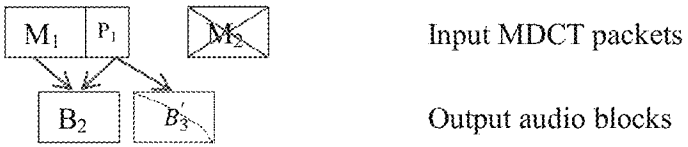
FIG. 11 illustrates one form of decoder operation when a packet is lost using the pre-PLC method.

Instead of using $[B_2B_2]$ or $[B_2\ 0]$ to generate $P_1$, it is possible to fill the second half of the MDCT input using a signal generated from a PLC algorithm such that we can encode the next frame without incurring an additional delay. For example, we can use a pitch based PLC algorithm to generate an artificial signal $B'_3$ and then construct an input signal as $[B_2B'_3]$ (FIG. 10). Then we embed the generated MDCT coefficient vector $P_1$ in the current MDCT packet together with $M_1$. In doing so, an inverse transform of MDCT coefficient vector $P_1$ can recover the lost information for two adjacent frames at the receiver (FIG. 11). The advantage of this approach over performing PLC at the receiver is that here we have a history signal in much better condition which is crucial to a PLC algorithm for synthesizing a new frame. At the receiver, the most important signal block $B_2$ is incomplete (only an aliased version). Furthermore, the history signal may contain previously synthesized signals and spectral holes due to quantization, which will all negatively affect PLC performance.

To summarize, these embodiments propose a solution to embed extra information in a packet during encoding, such that improved PLC performance can be achieved when there is a packet loss. The key novelty is that an input vector is artificially created to perform another forward MDCT transform without using look-ahead frames which doesn't add any extra complexity to the decoder.

Hybrid Envelope-Based LBR and Normal LBR

Some MDCT ENCODED SIGNAL standards support bitrates as low as 6.4 kbps, which has better quality over envelope-based LBR. However, bitrates can still be high and this can be computationally expensive. It is therefore desirable to use envelope-based LBR for selected audio frames to achieve lower bandwidth and complexity. One can interleave envelope-based LBR and normal LBR to avoid repeating the former too frequently. The ratio of the two can be derived based on the bandwidth constraints. FEC LBR schemes can be adapted based on audio content. Specifically, envelope-based LBR can be applied for the following frames: Unvoiced frames. Wrong spectra data presumably does not have a serious impact on quality. Low energy/loudness frames. Inferior quality of envelope-based LBR has lower perceptual impact.

Interpretation

Reference throughout this specification to "one embodiment", "some embodiments" or "an embodiment" means that a particular feature, structure or characteristic described in connection with the embodiment is included in at least one embodiment of the present invention. Thus, appearances of the phrases "in one embodiment", "in some embodiments" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter. For example, the scope of the expression a device comprising A and B should not be limited to devices consisting only of elements A and B. Any one of the terms including or which includes or that includes as used herein is also an open term that also means including at least the elements/features that follow the term, but not excluding others. Thus, including is synonymous with and means comprising.

As used herein, the term "exemplary" is used in the sense of providing examples, as opposed to indicating quality. That is, an "exemplary embodiment" is an embodiment provided as an example, as opposed to necessarily being an embodiment of exemplary quality.

It should be appreciated that in the above description of exemplary embodiments of the invention, various features of the invention are sometimes grouped together in a single embodiment, FIG., or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those skilled in the art. For example, in the following claims, any of the claimed embodiments can be used in any combination.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention.

In the description provided herein, numerous specific details are set forth. However, it is understood that embodiments of the invention may be practiced without these specific details. In other instances, well-known methods, structures and techniques have not been shown in detail in order not to obscure an understanding of this description.

Similarly, it is to be noticed that the term coupled, when used in the claims, should not be interpreted as being limited to direct connections only. The terms "coupled" and "connected," along with their derivatives, may be used. It should be understood that these terms are not intended as synonyms for each other. Thus, the scope of the expression a device A coupled to a device B should not be limited to devices or systems wherein an output of device A is directly connected to an input of device B. It means that there exists a path between an output of A and an input of B which may be a path including other devices or means. "Coupled" may mean that two or more elements are either in direct physical or electrical contact, or that two or more elements are not in direct contact with each other but yet still co-operate or interact with each other.

Thus, while there has been described what are believed to be the preferred embodiments of the invention, those skilled in the art will recognize that other and further modifications may be made thereto without departing from the spirit of the invention, and it is intended to claim all such changes and modifications as falling within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

The invention claimed is:

1. A method of encoding audio information for forward error correction reconstruction of a transmitted audio stream over a lossy packet switched network, the method including the steps of:

dividing the audio stream into audio frames;

determining a series of corresponding audio frequency bands for said audio frames;

determining a series of power envelopes for the frequency bands as part of encoding the audio frames, the encoding also including determining allocation data and spectrum data for the frequency bands;

determining content type of each audio frame, the content type being one of a vowel type and a fricative type;

encoding only a selected subset of the power envelopes as low bit rate versions of the audio frames in redundant transmission frames, the subset of the power envelopes for each of the audio frames being selected based on the content type of the audio frames;

performing forward error correction encoding for the audio stream by combining encoded audio frames with encoded redundant transmission frames; and transmitting frames of the forward error encoded audio stream over the lossy packet switched network.

2. A method as claimed in claim 1, further comprising:

encoding the audio frames in a first encoding format;

encoding the redundant transmission frames in a redundant encoding format, the performing forward error correction encoding further comprising combining the first encoding format and the redundant encoding format to thereby produce a fault tolerant version of the audio stream.

3. A method as claimed in claim 1 further comprising the step:

when decoding the redundant transmission, adding noise to the output signal by utilising a noise generator.

4. A method as claimed in claim 3 wherein said noise generator generates noise on the basis of the data in the redundant transmission frame.

5. A fault tolerant audio encoder for encoding an audio signal into a fault tolerant version of the audio signal, the encoder including a processor with instructions embodied therein to be executed by the processor, the instructions providing:

a primary encoder for encoding the audio signal in a first encoding format, comprising a first series of audio frames, with each audio frame including encoded information for a series of frequency bands, the encoding including determining a series of power envelopes, allocation data, and spectrum data for the frequency bands;

an intelligent detector for selecting a subset of the frequency bands for each of the audio frames by determining content type of each audio frame, the content type being one of a vowel type and a fricative type, and selecting the subsets for each audio frame based on the determined content types;

a redundant encoder for encoding the audio signal in a redundant encoding format comprising a second series of audio frames, with each audio frame including only encoded information of the power envelopes for the selected subset of frequency bands of the audio frame; and a forward error correction encoder for combining the first encoding format and the redundant encoding format, the forward error correction encoder also transmitting frames of the forward error encoded audio stream over the lossy packet switched network.

6. An encoder as claimed in claim 5 wherein the encoded information of the power envelopes is Huffman encoded across adjacent frames in said second series of audio frames.

7. A method of decoding a received fault tolerant audio signal, received as packets in a lossy packet switching network environment, the fault tolerant audio signal including:

a first series of audio frames, with each audio frame including spectral encoded information for a series of frequency bands;

a second series of audio frames, with each audio frame including only selected subsets of power envelopes for frequency bands of the audio frame, the fault tolerant audio signal comprising a combination of the first series of audio frames and the second series of audio frames encoded using forward error encoding, the subsets being selected based on determined content type of each audio frame, the content type being one of a vowel type and a fricative type, the method including the steps of:

detecting a lost packet;

replicating the spectral data from a previous frame;

modulating the replicated spectral data by the power envelope information for a current frame to generate a lost frame of the received audio signal to replace the lost packet; and inserting the generated lost frame into the received audio signal for subsequent playback.

8. A method of decoding a received fault tolerant audio signal, received as packets in a lossy packet switching network environment, the fault tolerant audio signal including:

a first series of audio frames, with each audio frame including spectral encoded information for a series of frequency bands;

a second series of audio frames, with each audio frame including only selected subsets of power envelopes for frequency bands of the audio frame, the fault tolerant audio signal comprising a combination of the first series of audio frames and the second series of audio frames encoded using forward error encoding, the subsets being selected based on determined content type of each audio frame, the content type being one of a vowel type and a fricative type, the method including the steps of:

detecting a lost packet;

generating a current frame from the power envelope information for a current frame and a spectral noise generator; and inserting the generated lost frame into the received audio signal for subsequent playback.

9. A method as claimed in claim 8 wherein the output of the spectral noise generator is based on the spectral data of a previous audio frame.

10. A method as claimed in claim 8, further comprising a step of:

decoding the fault tolerant audio signal to obtain the first series of audio frames and the second series of audio frames, by means of a forward error correction decoder.

11. A method of encoding audio information for forward error correction reconstruction of a transmitted audio stream over a lossy packet switched network, the method including the steps of:

dividing the audio stream into audio frames;

determining a series of corresponding audio frequency bands for said audio frames;

determining a series of power envelopes for the frequency bands as part of encoding the audio frames, the encoding also including determining allocation data and spectrum data for the frequency bands;

determining phase data and magnitude data from the audio frequency bands for the audio frames;

determining content type of each audio frame, the content type being one of a vowel type and a fricative type;

encoding a selected subset of the power envelopes as low bit rate versions of the audio frames in redundant transmission frames, the subset of the power envelopes for each of the audio frames being selected based on the content type of the audio frames;

encoding the phase and magnitude data as part of the redundant transmission frame;

performing forward error correction encoding for the audio stream by combining encoded audio frames with the encoded redundant transmission frames; and transmitting frames of the forward error encoded audio stream over the lossy packet switched network.

12. The method as claimed in claim 11, further comprising:

encoding signs of frequency coefficients for respective frequency bands together with the envelopes in the redundant transmission frame.

13. The method as claimed in claim 12 further comprising only encoding the phase and magnitude data of a number of the lowest frequency bands as part of the redundant transmission frame.

14. The method as claimed in claim 13 wherein the cutoff for the number of the lowest frequency bands is determined from audio content of a corresponding audio frame.

* * * * *